US008101842B2

(12) United States Patent
Lee et al.

(10) Patent No.: US 8,101,842 B2
(45) Date of Patent: Jan. 24, 2012

(54) MUSIC COMPARING SYSTEM AND METHOD

(75) Inventors: Hou-Hsien Lee, Taipei Hsien (TW); Chang-Jung Lee, Taipei Hsien (TW); Chih-Ping Lo, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 9 days.

(21) Appl. No.: 12/788,335

(22) Filed: May 27, 2010

(65) Prior Publication Data

US 2011/0120289 A1 May 26, 2011

(30) Foreign Application Priority Data

Nov. 20, 2009 (CN) ..... 2009 1 0310161

(51) Int. Cl.
*A63H 5/00* (2006.01)
*G04B 13/00* (2006.01)
*G10H 7/00* (2006.01)

(52) U.S. Cl. ..... 84/609

(58) Field of Classification Search ..... 84/609, 84/649

See application file for complete search history.

(56) References Cited

U.S. PATENT DOCUMENTS

| | | | | |
|---|---|---|---|---|
| 5,739,451 | A * | 4/1998 | Winksy et al. | 84/609 |
| 6,506,969 | B1 * | 1/2003 | Baron | 84/609 |
| 6,747,201 | B2 * | 6/2004 | Birmingham et al. | 84/609 |
| 6,967,275 | B2 * | 11/2005 | Ozick | 84/616 |
| 7,488,886 | B2 * | 2/2009 | Kemp | 84/609 |
| 7,838,755 | B2 * | 11/2010 | Taub et al. | 84/609 |
| 2008/0190272 | A1 * | 8/2008 | Taub et al. | 84/645 |

* cited by examiner

*Primary Examiner* — Jeffrey Donels
(74) *Attorney, Agent, or Firm* — Altis Law Group, Inc.

(57) ABSTRACT

A music comparing system determines whether a first song is same as a second song. Notes of the first and second songs are transcribed. A number of pitch differences between two adjacent notes of the first and second songs are recorded, and the pitch differences of the first song are transformed to a first relative step pattern, and the pitch differences of the second song are transformed to a second relative step pattern. The first and second relative step patterns are compared to determine whether the first and second songs are the same.

8 Claims, 4 Drawing Sheets

MUSIC COMPARING SYSTEM AND METHOD

BACKGROUND

1. Technical Field

The present disclosure relates to a music comparing system and a music comparing method.

2. Description of Related Art

Conventional music comparing systems focus on pitch, tempo, rhythm, key, and so on. However, if only the key or tempo of two songs are different, the two songs may be mistakenly regarded as two different songs rather than variations of the same song.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
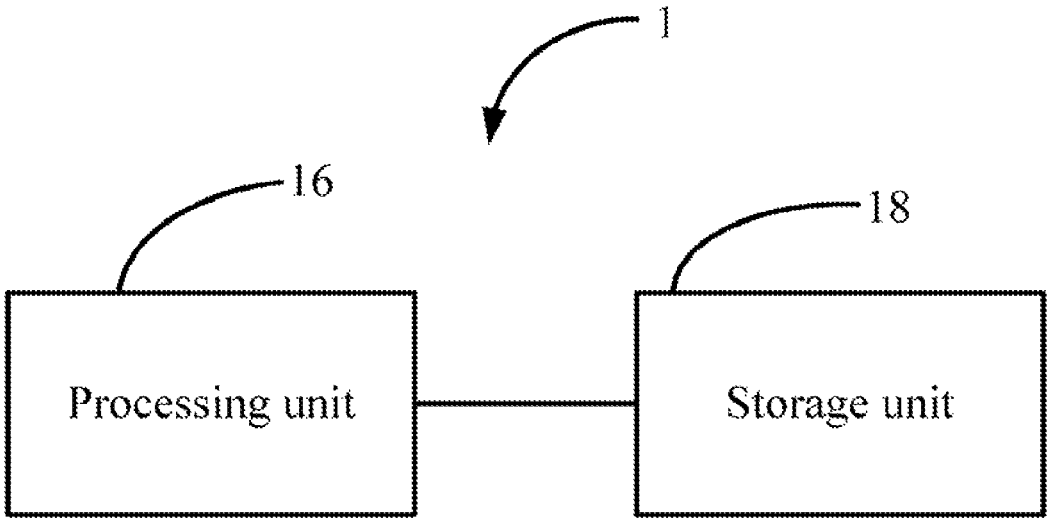
FIG. 1 is a block diagram of an exemplary embodiment of a music comparing system, the music comparing system includes a storage unit.

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

Referring to FIG. 1, an exemplary embodiment of a music comparing system 1 includes a processing unit 16 and a storage unit 18. The music comparing system 1 is operable to determine whether a first and a second song are the same.

Figure 2:
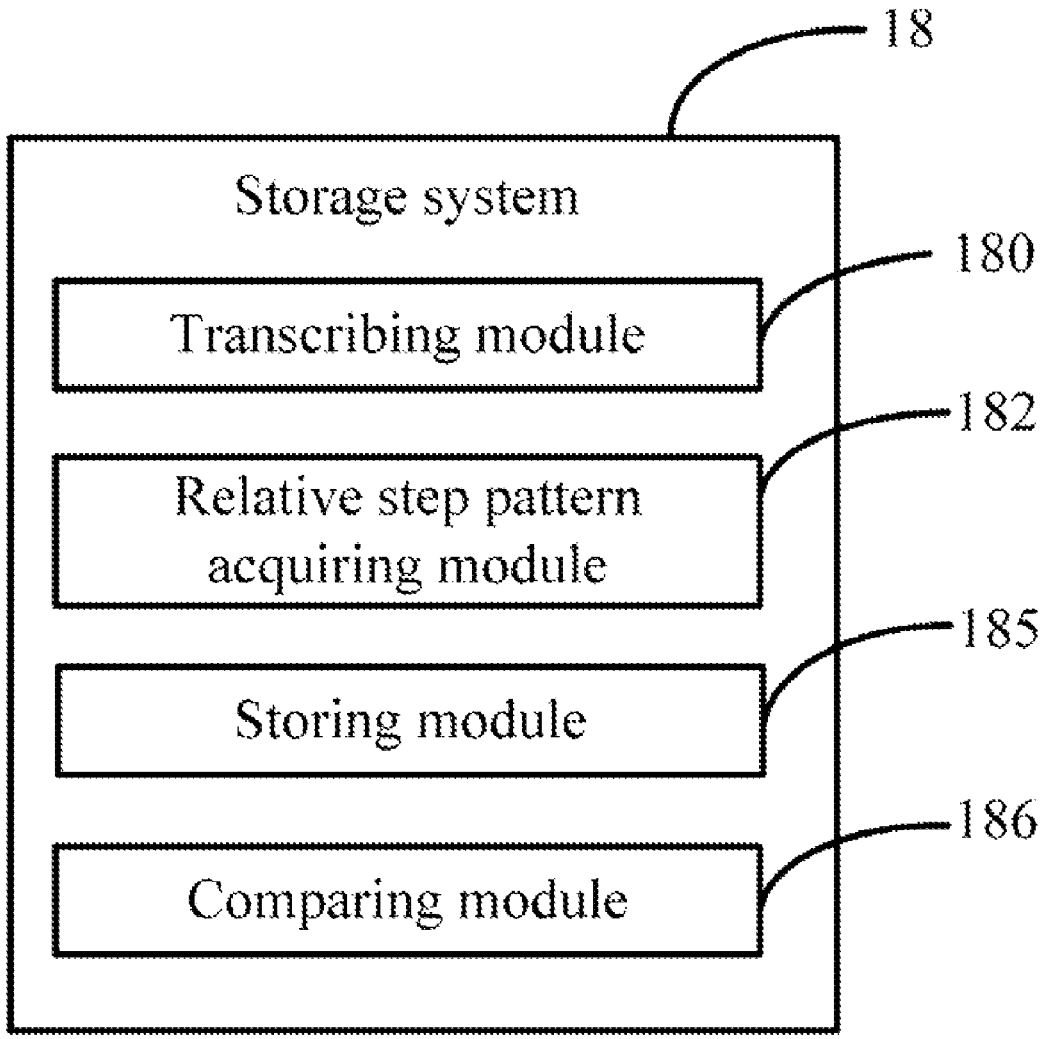
FIG. 2 is a block diagram of an exemplary embodiment of the storage unit of FIG. 1.

Referring to FIG. 2, the storage unit 18 includes a transcribing module 180, a relative step pattern acquiring module 182, a storing module 185, and a comparing module 186. The transcribing module 180, the relative step pattern acquiring module 182, and the comparing module 186 may include one or more computerized instructions that are executed by the processing unit 16.

The transcribing module 180 transcribes notes of a first song on a music staff, and notes of a second song on a music staff. When a song is played by a computer system, the transcribing module 180 stored in the storage unit 18 of the computer system can produce some sort of graph, such as notes recorded on a staff, corresponding to the song. It can be understood that the transcribing module 180 is similar to a melograph.

The relative step pattern acquiring module 182 records a plurality of pitch differences between two adjacent notes recorded on the staff of each of the first and second songs, and transforms the pitch differences of the first song to a first relative step pattern and transforms the pitch differences of the second song to a second relative step pattern. Each of the first and second relative step patterns includes a series of numbers. A first number in each series is a benchmark value, such as "0". Each of the other numbers in each series is a value showing a pitch difference between a later adjacent note and a former adjacent note recorded on the staff. For example, a second number in the series is a pitch difference between a second note and a first note recorded on the staff of the first or second song. A third number in the series is a pitch difference between a third note and the second note recorded on the staff of the first or second song.

The storing module 185 stores the first and second relative step patterns. The comparing module 186 compares the first and second relative step patterns. Upon the condition that the first and second relative step patterns are the same, the first and second songs are considered to be the same, otherwise they are considered as different songs.

Figure 3:
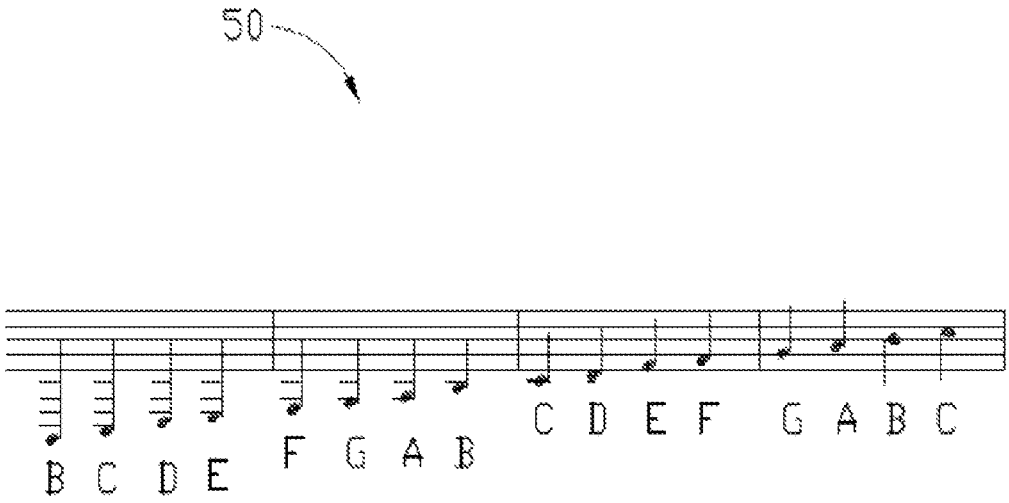
FIG. 3 is a schematic diagram of notes of a song recorded on a music staff.

Referring to FIG. 3, notes of the first song are recorded on a music staff 50. It can be understood that the notes recorded on the music staff 50 may be for a song, a scale or other practice melody. Here the notes recorded on the music staff 50 are just an example for explaining how the relative step pattern acquiring module 182 works. The transcribing module 180 produces the notes recorded on the staff 50 when the first song is played by the computer system. In the embodiment, the relative step pattern acquiring module 182 defines a pitch of a first note B on the music staff 50 as a number "0". A halftone between pitch of two notes is defined as a number "1". As a result, a number corresponds to the pitch difference between the second note C and the first note B recorded on the staff 50 is "2". In this way, the first relative step pattern corresponding to the first song is (0, 2, 2, 2, 2, 2, 2, 2, 2, 2, 2, 2, 2, 2, 2, 2). The first relative step pattern is stored in the storing module 185.

Like the first relative step pattern, the music comparing system 1 can obtain the second relative step pattern corresponding to the second song. The second relative step pattern is stored in the storing module 185. Suppose that the second relative step pattern is (0, 2, 2, 2, 2, 2, 2, 0, 2, 2, 2, 2, 2, −4, 2, 2). In the second relative step pattern, an eighth number "0" denotes that the note in the eighth position and the note in the seventh position of the second song are the same. A fourteenth number "−4" denotes that the note in the thirteen position is four halftones higher than the note in the fourteenth position.

The comparing module 186 compares the first and second relative step patterns to determine whether the two relative step patterns are the same. If the comparison shows the two relative step patterns are an 85% or higher match, the two songs are regarded as the same. The choice of 85% can be preset and be any suitable value. Otherwise, the two songs are regarded as different, that is if the comparison shows a likeness of less than 85%, the two songs are considered as two different songs. In the embodiment, it is determined that there are fourteen numbers the same and orders of the fourteen numbers are the same, namely 87.5% of the first relative step pattern is the same as the second relative step pattern. As a result, the first and second songs may be regarded as the same.

Figure 4:
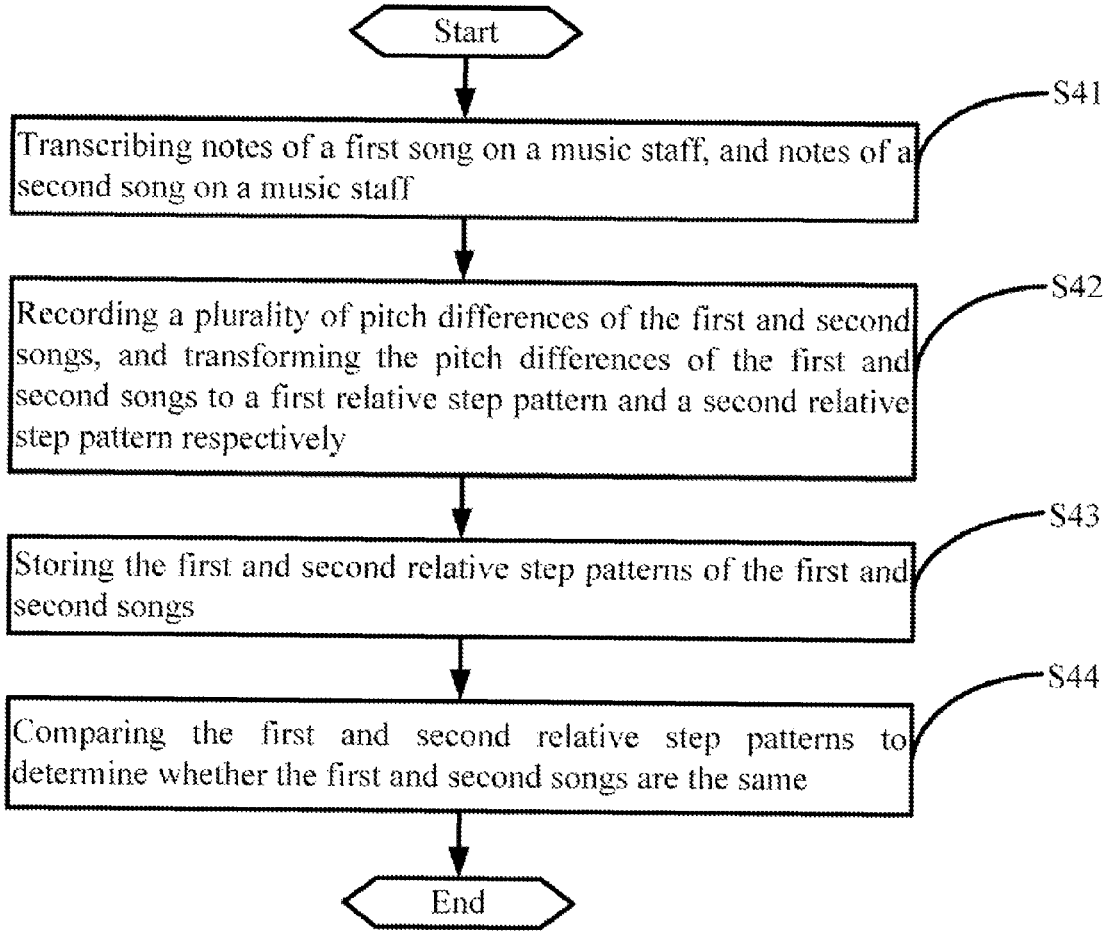
FIG. 4 is a flowchart of an exemplary embodiment of a music comparing method.

Referring to FIG. 4, an exemplary embodiment of a comparing method includes the following steps.

In step S41, the transcribing module 180 transcribes notes of a first song on a music staff, and notes of a second song on a music staff.

In step S42, the relative step pattern acquiring module 182 records a plurality of pitch differences between two adjacent notes recorded on the staff of each of the first and second songs, and transforms the pitch differences of the first song to a first relative step pattern and transforms the pitch differences of the second song to a second relative step pattern. Each of the first and second relative step patterns includes a series of numbers. A first number in the series of numbers is a benchmark value, such as "0". Each of other numbers in the series of numbers is a pitch difference between two adjacent notes recorded on the staff, such as a later note and a former note recorded on the staff. For example, a second number in the series numbers denotes a pitch difference between the note in the second position and the note in the first position of the first or second song. A third number in the series of numbers denotes a pitch difference between the note in the third position and the note in the second position of the first or second song.

In step S43, the storing module 185 stores the first and second relative step patterns of the first and second songs.

In step S44, the comparing module 186 compares the first and second relative step patterns to determine whether the first and second relative step patterns are the same, and to determine whether the first and second songs are the same. In the embodiment, if greater than n% of the first relative step pattern is the same as the second step pattern, the first and second songs are regarded as the same. It can be understood that n% is a preset value.

The foregoing description of the exemplary embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A music comparing system comprising:

a processing unit;

a storage unit connected to the processing unit and storing a plurality of programs to be executed by the processing unit, wherein the storage unit comprises:

a transcribing module to transcribe notes of a first song on a music staff, and notes of a second song on a music staff;

a relative step pattern acquiring module to record a plurality of pitch differences between two adjacent notes recorded on the music staff of each of the first and second songs, and transforms the pitch differences of the first song to a first relative step pattern and transforms the pitch differences of the second song to a second relative step pattern; and a comparing module to compare the first and second relative step patterns to determine whether the first and second songs are the same.

2. The music comparing system of claim 1, wherein each of the first and second relative step patterns comprises a series of numbers, a first number in the series of numbers is a benchmark value, each of other numbers in the series of numbers is a value showing a pitch difference between a later adjacent note and a former adjacent note recorded on the music staff.

3. The music comparing system of claim 1, wherein upon the condition that greater than n % of the first relative step pattern is same as the second relative step pattern, the first and second songs are regarded as the same, n % being a preset value, n is greater than zero.

4. A music comparing method for the music comparing system of claim 1, the music comparing method comprising:

transcribing notes of a first song on a music staff, and notes of a second song on a music staff through the transcribing module;

recording a plurality of pitch differences between two adjacent notes recorded on the music staff of each of the first and second songs through the relative step pattern acquiring module;

transforming the pitch differences of the first song to a first relative step pattern and transforming the pitch differences of the second song to a second relative step pattern through the relative step pattern acquiring module; and comparing the first and second relative step patterns to determine whether the first and second songs are the same through the comparing module.

5. The music comparing method of claim 4, wherein each of the first and second relative step patterns comprises a series of numbers, a first number in the series of numbers is a benchmark value, each of other numbers in the series of numbers denotes a pitch difference between a later adjacent note and a former adjacent note recorded on the music staff.

6. The music comparing method of claim 5, wherein upon the condition that greater than n % of the first relative step pattern is same as the second relative step pattern, the first and second songs are regarded as the same, n % being a preset value, n is greater than zero.

7. The music comparing system of claim 3, wherein n equals to 85.

8. The music comparing method of claim 6, wherein n equals to 85.

* * * * *